United States Patent [19]

Terzian et al.

[11] 4,386,479

[45] Jun. 7, 1983

[54] WALKING DOLL

[75] Inventors: Rouben T. Terzian, Chicago; Walter J. Wozniak, Addison, both of Ill.

[73] Assignee: Marvin Glass & Associates, Chicago, Ill.

[21] Appl. No.: 203,987

[22] Filed: Nov. 4, 1980

[51] Int. Cl.[3] ..... A63H 11/00

[52] U.S. Cl. ..... 46/102; 46/149; 46/163

[58] Field of Search ..... 46/102, 110, 99, 101, 46/107, 149, 150, 161, 163, 173, 126

[56] References Cited

U.S. PATENT DOCUMENTS

| | | | |
|---|---|---|---|
| 1,674,943 | 6/1928 | Berger | 46/150 X |
| 1,815,183 | 7/1931 | Brown et al. | 46/120 |
| 2,174,932 | 10/1939 | Weis et al. | 46/161 |
| 2,350,114 | 5/1944 | Katz | 46/173 |
| 2,615,282 | 10/1952 | Ueltschi | 46/126 |
| 2,884,739 | 5/1959 | Ketcham | 46/163 |
| 3,012,893 | 1/1961 | Schwartz | 46/163 |
| 3,038,275 | 6/1962 | Curci | 46/150 X |
| 3,234,689 | 2/1966 | Ryan | 46/163 X |
| 3,254,442 | 6/1966 | Ostrander | 46/161 |
| 3,611,626 | 10/1971 | Bornn | 46/120 |

FOREIGN PATENT DOCUMENTS

| | | | |
|---|---|---|---|
| 192818 | 11/1957 | Austria | 46/149 |
| 344940 | 4/1960 | Switzerland | 46/149 |
| 11785 | of 1889 | United Kingdom | 46/102 |
| 22407 | of 1897 | United Kingdom | 46/102 |

*Primary Examiner*—F. Barry Shay

*Attorney, Agent, or Firm*—McDermott, Will & Emery

[57] ABSTRACT

A walking doll is described having a pair of side by side legs which automatically pivot forwardly when lifted off the ground. The legs include movable, side by side buttocks. The doll may be connected to a stroller through a handle that oscillates from side to side as the stroller is forwarded. When the doll is connected to the handle the doll rocks from side to side causing one leg after another to be lifted from the ground. As a leg is lifted from the ground an eccentric weight within the leg causes the leg to step forwardly until the handle is rotated in the opposite direction at which time the leg again contacts the ground and the other leg is lifted off the ground. The handle is oscillated by a cam follower which follows a cam rotated by an axle of the stroller.

13 Claims, 11 Drawing Figures

Fig 1
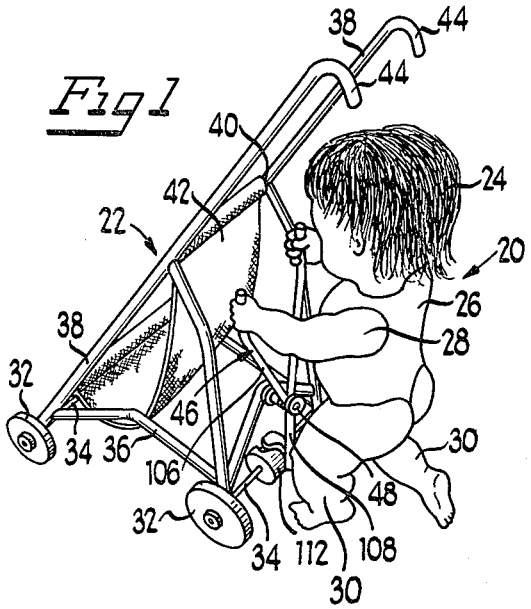
Fig 2
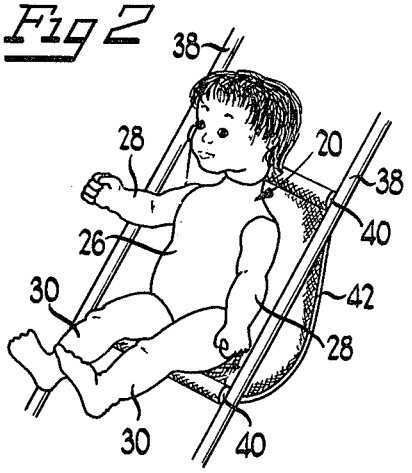
Fig 3
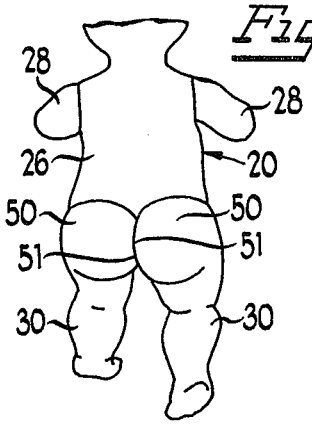
Fig 4
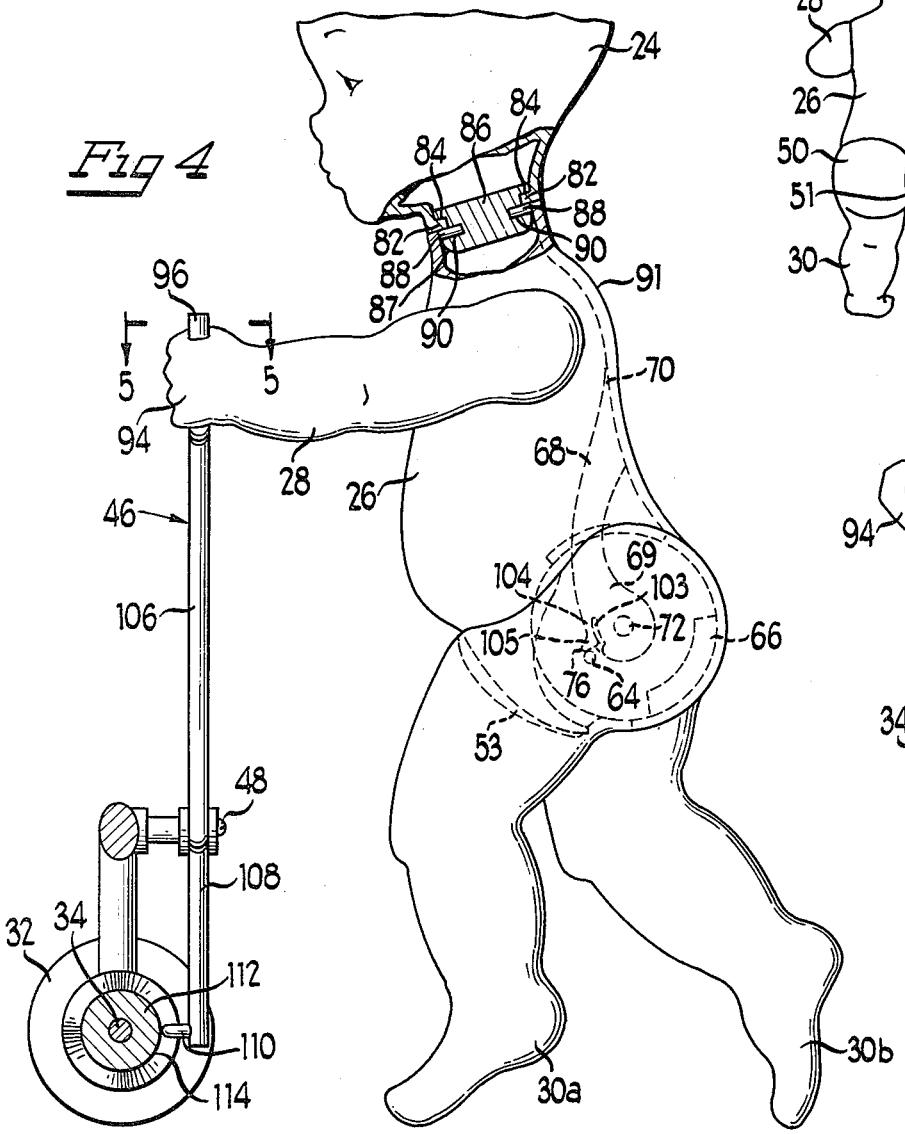
Fig 5
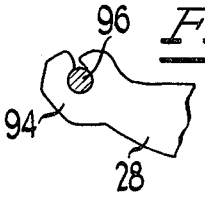
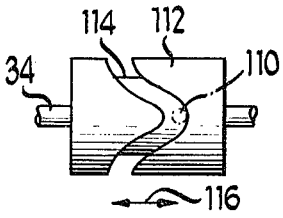
Fig 6

Fig 7
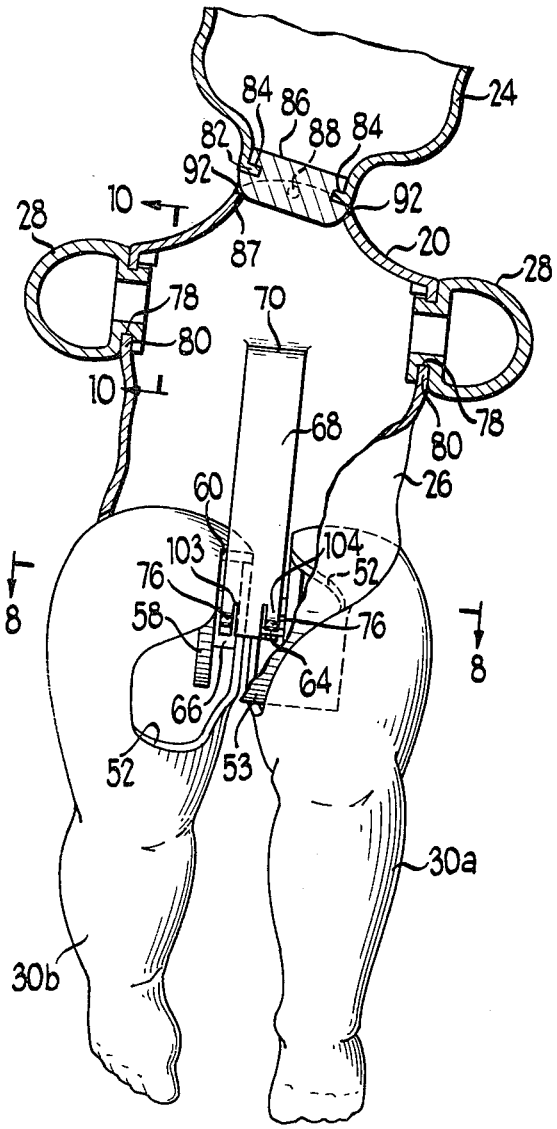
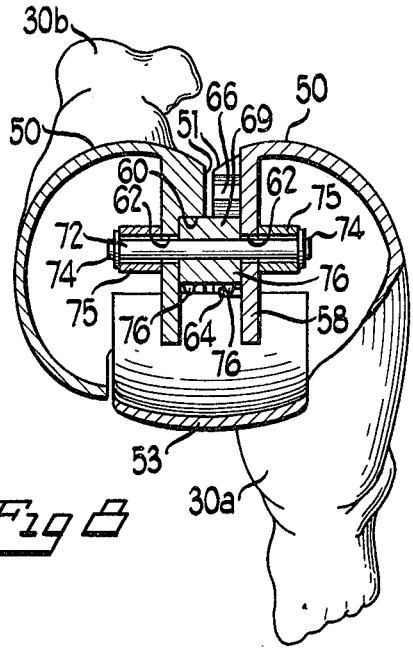
Fig 8
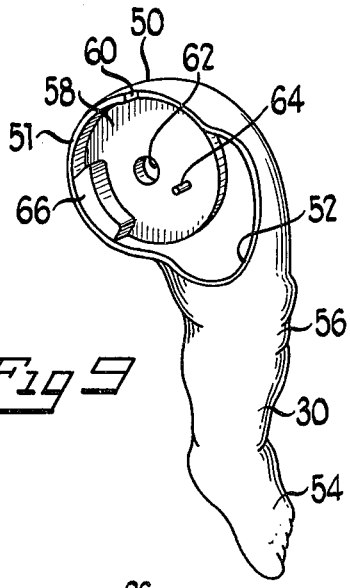
Fig 9
Fig 10
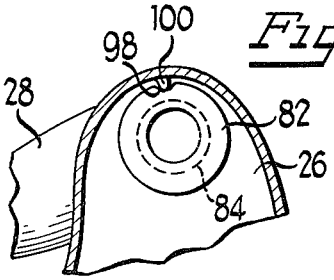
Fig 11
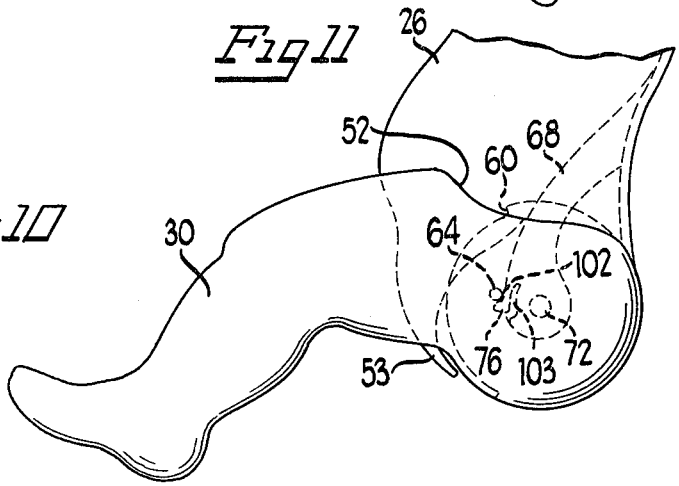

WALKING DOLL

BACKGROUND OF THE INVENTION

1. Field Of The Invention

This invention relates generally to walking dolls and specifically to stroller dolls.

2. Brief Description Of The Prior Art

The prior art includes many examples of dolls whose legs can be pivoted. Dolls with pivoted legs having independently articulated buttocks are also known. For example U.S. Pat. No. 3,254,442 issued to Ostrander shows a doll whose legs are connected by a central flanged pin.

Dolls that walk with strollers are also known in the art. For example U.S. Pat. No. 3,453,772 issued to Schneider discloses a doll having two pivotal legs that move forwardly when the weight of the doll is shifted from one leg to the other. The doll is shifted by the swaying motion caused by the stroller's eccentrically mounted wheels. The swaying motion is transferred to the doll through a rear pin connecting the doll and stroller. Combined walking dolls and strollers are also disclosed in U.S. Pat. Nos. 3,940,879, 3,077,052 and 2,896,371. These patents describe structures deficient in that the swaying motion of the doll is unnaturally experienced by the stroller as well, or unnatural external linkages or expensive internal motors are necessary.

SUMMARY OF THE INVENTION

It is an object of the present invention to provide an improved walking doll with independently articulated buttocks.

It is another object of the present invention to provide an inexpensive combined walking doll and stroller in which the doll is swayed from side to side without unnatural stroller motion.

These and other objects of the present invention are achieved by a walking doll with a body having arms and a neck at the upper end with a head attached to the neck. A pair of side by side legs connected to the lower end of the body for independent rotation around a first axis include means for rotating each leg automatically when lifted from a surface. A toy wheeled vehicle including a handle and means for rotating the handle relative to the vehicle from side to side around an axis transverse to the first axis in response to movement of the vehicle is included as well. Means for connecting the handle to the doll cause the doll to be pivoted from side to side with the handle.

BRIEF DESCRIPTION OF THE DRAWING

FIG. 1 is a perspective view of one embodiment of the doll and stroller combination;

FIG. 2 is a partial, perspective view of the doll and stroller combination shown in FIG. 1 with the doll sitting in the stroller;

FIG. 3 is a partial, rear elevational view of the doll shown in FIG. 1;

FIG. 4 is a partial, cut away, side elevational view of the doll and stroller shown in FIG. 1;

FIG. 5 is a cross-sectional view taken generally along the line 5—5 of FIG. 4;

FIG. 6 is a front elevational view of the cam shown in FIG. 1;

FIG. 7 is a partial, cut away, front elevational view of the doll shown in FIG. 1 with one leg raised off the surface;

FIG. 8 is a cross-sectional view taken generally along the line 8—8 in FIG. 7;

FIG. 9 is a perspective view of one leg of the doll shown in FIG. 7;

FIG. 10 is a partial, cross-sectional view taken generally along the line 10—10 in FIG. 7; and FIG. 11 is a partial, cut-away, side elevational view of the doll shown in FIG. 2.

DESCRIPTION OF THE PREFERRED EMBODIMENT

Referring to the drawing wherein like reference characters are used for like parts throughout the several views, a doll 20 releasably connected to a stroller 22 is illustrated in FIG. 1. The doll 20, conveniently made of molded plastic, includes a head 24, a torso 26, arms 28 and legs 30. The stroller 22 includes two pairs of wheels 32 mounted on axles 34 and a support framework 36.

The support framework 36 is connected through bearings (not shown) to axles 34 and includes a pair of spaced grasping bars 38 connected by parallel transverse bars 40. A piece of flexible fabric 42 is loosely attached between transverse bars 40 to form a seat. The upper ends 44 of grasping bars 38 are curved to permit a child to conveniently push the stroller 22 and for added safety. A lower pivotal handle 46 is connected to the rear side of support framework 36 by a pivot pin 48.

As shown in FIGS. 1 and 2 the arms 28 and legs 30 of the doll 20 are pivotable to assume various poses. As shown in FIG. 2 the legs 30 of the doll have been pivoted upwardly to extend in front of the doll and arms 28 have been pivoted to different positions relative to the doll 20. Thus the doll 20 can be positioned to sit within the stroller 22 on fabric 42 as shown in FIG. 2.

As shown in FIGS. 3 and 9, the legs 30 of doll 20 include a pair of side by side buttocks 50, conveniently integral with legs 30, movable relative to torso 26. Each buttock 50 includes an inner, curved flange 51 extending closely adjacent the flange 51 of the other buttock 50, covering the internal workings of the doll 20 and creating a realistic appearance. Preferably, legs 30 are arranged to extend only slightly outwardly from beneath torso 26 when legs 30 extend downwardly. As shown in FIG. 7, the U-shaped, contoured upper, front edges 52 of legs 30 are shaped to enable the legs to rotate relative to the torso 26 without interference. The contoured upper, front edges 52 conform to the torso 26 when a leg 30 is in the forward walking position illustrated by leg **30*a* in FIG. 4 or the forward sitting position shown in FIG. 11. A body extension 53 extends from torso 26 downwardly between legs 30 to conceal the inside of doll 20 that would otherwise be exposed by contoured upper edges 52 of legs 30**.

As shown in FIG. 9, the legs 30 each include a downwardly directed foot 54, a knee 56, a vertically aligned, attachment disc 58 and a rearward motion stop 60. The disc 58 includes a central aperture 62, an outwardly extending forward motion stop 64, in the form of a pin, and a weight 66. The legs 30 are mounted for rotation on an internal, curved, downwardly directed support or strut 68 secured on its upper end to the back region 70 of the inside of the doll 20. As best shown in FIG. 8, an axle 72 passes through the base of the support 68 and the apertures 62 of each leg 30, retained in position by heads 74 and tubular sleeves 75. Thus each leg 30 is permitted to independently rotate around axle 72 limited only by stops 60 and 64. In this arrangement the buttocks 50 are positioned side by side but are capable of relative motion with respect to one another. Since weight 66 is spaced from axle 72 it exerts a moment around the axle whenever the weight 66 is not positioned directly beneath axle 72. A pair of spaced pins 76 are positioned on the lower end of support 68 facing forwardly to contact forward motion stops 64 of each leg 30 when the leg 30 is in its forward walking position. In addition, rearward motion stops 60 are aligned to contact the back side 69 of the support 68 when legs 30 are in their rearwardmost position illustrated by leg **30*b* in FIG. 8**.

Thus, the doll can be grasped, for example, by the torso, and caused to walk across the floor or other surface in a very realistic manner. This is accomplished by tilting the doll from side to side as it is moved forward. The respective weights 66 will move or pivot the lifted leg forward as the opposite leg is moved rearwardly.

A pair of arms 28 are also mounted for pivotal movement around a common axis extending through the doll 20 transverse to its length. As shown in FIG. 7, each arm 28 includes on its upper end an annular recess 78 engaged by a flat, annular torso portion 80 to permit rotation of arms 28 relative to torso 26. Conveniently arms 28 are made of resilient plastic to permit the arms to be positioned partially within torso 26.

As shown in FIGS. 4 and 7, head 24 is rotatable around an axis extending along the length of the doll 20 and pivotable around an axis aligned with the direction of doll forward movement and extending transverse to the length of the doll 20. The lower portion of the head 24 includes an annular inwardly directed flange 82 slidably mounted in a recess 84 within disc-shaped plug 86. The plug 86 is connected to torso 26 through collinearly aligned pins 88. These pins 88 each rotatably telescope within tubular recesses 90 in plug 86 on the doll front and rear sides 89 and 91. As shown in FIG. 7 the base 87 of plug 86 is tapered and the upper edges 92 of torso 26, intermediate between pins 88, taper downwardly away from plug 86 to permit the pivoting action of the head 24. By telescoping the pins 88 loosely within recesses 90 the head 24 pivots from side to side when the doll 20 is swayed from side to side.

As shown in FIG. 5, the arms 28 of doll 20 include hands 94 designed to encircle and frictionally grip the upper ends 96 of handle 46. In addition, the arms 28 may be locked in the handle gripping position. As shown in FIG. 10, the annular flange 95 of arms 28 includes a notch 98 engageable by an outwardly directed, flexible pin 100 connected to torso 26. When arms 28 are directed straight forwardly as shown in FIG. 4, the pin 100 will engage notch 98 locking the arms 28 in that position. When the arms are forceably rotated from that position pin 100 will be flexed causing it to leave notch 98 and rotate around the periphery of flange 82.

Similarly legs 30 can be locked in their forwardmost sitting position shown in FIGS. 2 and 11. Pins 76 located over recesses 103 in support 68 include an outwardly directed tab 102 having curved sides 105, mounted on an arm 104. The arm 104 is flexible permitting the outwardly directed tab 102 to be flexed towards axle 72 and causing the tab 102 to spring back to its original position after the force is released. Thus when legs 30 are in their forward walking position with stop 64 pressing against outwardly directed tab 102 as shown in FIG. 4, continued application of force to the legs while retaining the torso 26 stationary causes outwardly directed tab 102 to move inwardly by flexing arm 104 until stop 64 extends over tab 102 to the locked, sitting position shown in FIG. 11. When it is desired to return the legs 30 to their downward walking position the legs are rotated in the appropriate direction with sufficient force to again flex arm 104 allowing stop 64 to pass over outwardly directed tab 102 to return to the position shown in FIG. 4.

As shown in FIG. 4, handle 46 includes a pair of upwardly extending bars 106 arranged in a V-shape yoke, secured to a downwardly extending bar 108 at the region of the pivot pin 48. The downwardly extending bar 108 includes a transversely, forwardly protruding cam follower 110 that engages a cam 112 mounted on an axle 34. The axle 34 is fixed to wheels 32 so that rotation of wheels 32 causes cam 112 to rotate. The cam 112 includes a helical recess or shunt 114 extending completely around the periphery of the cam 112. Thus when wheels 32 are rotated cam follower 110 undergoes a side to side oscillation in the direction of arrows 116 in FIG. 6, as it follows the helical path of recess 114. The side to side motion of follower 110 causes a rotation in the opposite direction of the upper ends 96 of handle 46 of greater amplitude due to the fact that bars 106 are longer than bar 108. This oscillation is not transmitted to stroller 22 since the pivoting pin 48 permits handle 46 to rotate relative to the stroller 22.

The illustrated embodiment operates as follows. The doll 20 is positioned behind stroller 22 with its hands 94 positioned on the upper ends 96 of the handle 46. The arms 28 are locked in their outwardly extending position by pin 100 retained in notch 98. The user then pushes the stroller 22 by grasping curved ends 44 of grasping bars 38 and pushing forwardly over the top of the doll 20. As the wheels 32 rotate, cam 112 fixed on axle 34 also rotates. This causes cam follower 110 to move from side to side along the length of axle 34 as it follows the recess 114 in cam 112. As a result downwardly extending bar 108 rotates to one side around pivoting pin 48, while upper ends 96 of handle 46 rotate in an opposite direction. The oscillation of the upper ends 96 of handle 46 is transmitted through hands 94 and locked arms 28 of doll 22 to torso 26. The resultant doll side to side swaying motion causes all the weight of the doll to be placed on one leg 30 and lifts the other leg 30 off the ground as shown in FIG. 7.

When a leg **30*b* in its rearward position is lifted off the ground it automatically moves forwardly. This is accomplished by weight 66 eccentrically located on disc 58 to exert a downward gravitational force when the leg 30 is in the rearward position. This downward force causes weight 66 and disc 58 to rotate and leg 30 to extend forwardly. The rotation continues until forward motion stop 64 contacts pin 76 on support 68. At this time the weight 66 is directly below the axle 72 with the contoured edge 52 adjacent the front portion of torso 26. The other leg 30*a*, previously in its forward walking position, has now been left behind (not shown) and trails the leg 30*b*. When the cam follower 110 moves in the opposite direction due to the continued rotation of wheels 32 the weight of the doll is shifted from leg 30*a* to 30*b*. At the same time the entire doll 20 is canted to one side bringing leg 30*a* off the surface. Leg 30*a* then moves forwardly as described previously with respect to leg 30*b***. In this way the legs move forwardly one after the other to simulate walking.

The doll 20 can be released from the stroller 22 by pulling hands 94 free of handle 46, and the arms 28 and legs 30 can then be rotated to different positions. By the application of a downward force to arms 28 pin 100 is flexed away from and slides out of notch 38 until the arms 28 rotate freely. Thus the arms 28 can take either the forwardly or the downwardly directed positions shown in FIG. 2 or any position therebetween. In addition, legs 30 can be rotated to their forwardly extending sitting position shown in FIG. 2 by the application of an upward force to each leg 30. The force is applied until forward motion stop 64 cams pin 76 inwardly towards axle 72, slides over stop 64, and becomes locked on the other side of pin 76. The doll 20 can then be placed in the stroller 22 as shown in FIG. 2.

The foregoing detailed description has been given for clearness of understanding only. No unnecessary limitations should be understood therefrom as many modifications will be obvious to those skilled in the art.

What is claimed is:

1. A walking doll comprising;

a torso with arms and a neck at the upper end, said arms each including a hand adapted to releasably encircle a respective one of a pair of handles and being rotatable with respect to said torso around an axis transverse to the length of said doll and including means for releasably locking said arms in a position with said hands secured to the handles;

a pivot pin connected to said neck;

a head pivotally mounted on said pivot pin, for side to side pivotal action in response to the side to side movement of said torso;

a pair of side by side legs connected to the lower end of said torso for independent rotation around a first axis and including means for rotating each leg automatically when lifted from a supporting surface while in a rearwardly rotated position;

a vehicle including means for generating side to side periodic motion of a structure having a pair of handles connected to said vehicle in response to movement of said vehicle over a supporting surface; wherein said handles provide means for connecting said structure moved by said periodic motion generating means to said doll to cause said doll to walk forwardly in a realistic manner, swaying from side to side, said head pivoting from side to side in response to the swaying movement of said doll.

2. The doll of claim 1 including movable, independently articulatable, side by side buttocks.

3. The doll of claim 1 wherein said legs are rotated automatically by means of an eccentrically located weight.

4. The doll of claim 1 wherein said structure for generating periodic motion comprises a handle secured to said vehicle by a pivotal connection.

5. The doll of claim 1 wherein said structure for generating motion includes a cam rotated by the forward movement of said toy vehicle, said cam having a helical groove formed therein, said handle including a cam follower which follows said helical groove.

6. The doll of claim 5 wherein said handle includes an intermediate pivot point and two upstanding membes grasped by the arms of said doll and a member extending downwardly from said pivot point and attached to said cam follower.

7. The doll of claim 1 wherein said legs are rotatable to a sitting position, said legs including means for locking said legs in said sitting position.

8. The doll of claim 1 wherein said legs have stop means cooperable with stop means on said torso for limiting the free forward and reverse rotation of said legs to a predetermined arc.

9. The doll of claim 8 wherein said stop means includes a depressable tab for limiting the forward motion of said legs, said tab being displaceable to permit said legs to be rotated past said tab to a sitting position.

10. The doll of claim 1 wherein said legs are mounted on a member extending downwardly through the torso of said doll, said legs being attached to either side of said member.

11. The doll of claim 10 wherein said legs include contoured forward upper edges conforming generally to the shape of the torso in their forwardly rotated position to permit said legs to move forwardly with respect to said torso without interference with said torso.

12. The doll of claim 1, said head being rotatable around an axis extending along the length of said doll.

13. A walking doll comprising:

a torso with arms and a neck at the upper end;

a head attached to said neck;

a pair of side by side legs connected to the lower end of said torso for independent rotation around a first axis including means for rotating each leg automatically when lifted from a supporting surface while in a rearwardly rotated position;

a vehicle including means for generating a periodic motion of a structure connected to said vehicle in response to movement of said vehicle over a supporting surface;

means for connecting said structure moved by said periodic motion generating means to said doll to cause said doll to walk forwardly in a realistic manner; and stop means on said legs and said torso, said stop means on said legs cooperable with said stop means on said torso for limiting the free forward and reverse rotation of said legs to a predetermined arc, said stop means including a depressible tab for limiting the forward motion of said legs, said tab being displaceable to permit said legs to be rotated past said tab to a sitting position.

* * * * *